US006024316A

United States Patent [19]

Klein

[11] Patent Number: 6,024,316

[45] Date of Patent: Feb. 15, 2000

[54] METHOD AND PLANT FOR TRANSFERRING A WIRE COIL FROM A COIL FORMING STATION OF A COOLING CONVEYOR ONTO A C-SHAPED HOOK OF A HOOK-TYPE CONVEYOR

[75] Inventor: Dieter Klein, Siegen, Germany

[73] Assignee: SMS Schloemann-Siemag Aktiengesellschaft, Düsseldorf, Germany

[21] Appl. No.: 09/065,322

[22] Filed: Apr. 23, 1998

[30] Foreign Application Priority Data

Apr. 26, 1997 [DE] Germany ..... 197 17 769

[51] Int. Cl.[7] ..... B21C 47/24

[52] U.S. Cl. ..... 242/363; 140/102

[58] Field of Search ..... 242/363, 533.2, 242/533.7; 198/409; 140/1, 2, 102

[56] References Cited

U.S. PATENT DOCUMENTS 4,251,037 2/1981 Puchovsky ..... 242/363

FOREIGN PATENT DOCUMENTS 3525089 9/1995 Germany .

*Primary Examiner*—John Q. Nguyen

*Attorney, Agent, or Firm*—Friedrich Kueffner

[57] ABSTRACT

A method and a plant for transferring a wire coil from a coil forming chamber of a coil forming station of a cooling conveyor onto a C-shaped hook of a hook-type conveyor equipped with travel rails, wherein the wire coils are transferred directly onto the vertically swung hooks. The hook-type conveyor includes device for opening and closing a travel rail area and a cooperating gripping device with a frame receiving the gripping device, and with a drive for swinging the hook from a horizontal position into a vertical position and vice versa, and a drive for raising and lowering a hook, and finally a drive for longitudinally moving a hook.

16 Claims, 6 Drawing Sheets

METHOD AND PLANT FOR TRANSFERRING A WIRE COIL FROM A COIL FORMING STATION OF A COOLING CONVEYOR ONTO A C-SHAPED HOOK OF A HOOK-TYPE CONVEYOR

BACKGROUND OF THE INVENTION

1. Field of the Invention

The present invention relates to a method and a plant for transferring a wire coil from a coil forming chamber of a coil forming station of a cooling conveyor onto a C-shaped hook of a hook-type conveyor equipped with travel rails.

2. Description of the Related Art

Conveyor systems, for example, with overhead tracks and with the possibility of carrying out transfer procedures are known in the art. They provide the possibility of transferring wire coils from conveying units to other conveying circuits, auxiliary travel paths or lifting stations. Also possible is the controlled travel through switches. In the current state of the art, such conveying systems have to carry out far-reaching tasks, for example, distributing, sorting or acting as buffers, wherein all of this has to be carried out at relatively high conveying capacities. On the other hand, also known in the art are fully automatic wire coil forming stations downstream of wire trains.

For example, DE 35 25 089 C2 describes a wire coil forming station following a coiler with cooling line which includes several receiving mandrels which are arranged inclined on a shaft at equal angle distances from each other and at the same angle relative to the axis thereof and which can be swung by rotating the shaft successively into an approximately vertical coil forming position or an essentially horizontal coil transfer position, wherein segments of the receiving mandrels can be moved in such a way that the circumference of the receiving mandrels changes. For this purpose, the segments are coupled to the shaft through a mechanical forced control, so that the segments are moved during the rotary movement of the shaft and as a result of the rotary movement of the shaft with changing circumferences of the receiving mandrels.

SUMMARY OF THE INVENTION

Therefore, starting from the prior art described above, it is the primary object of the present invention to render superfluous such a coil tilting or transfer device which was previously required, in order to shift the relatively complicated means for tilting the coil away from the coil forming station and, thus, to simplify the coil forming station.

In accordance with the present invention, the wire coils are transferred directly onto the vertically swung hooks.

As a result of the configuration according to the present invention, the coil forming station does not have the elements of the coil tilting or transfer devices which require relatively frequent maintenance and may also be susceptible to trouble, so that a problem-free operation with a high capacity is safely ensured.

In accordance with a further development of the method according to the present invention, after opening a travel rail area provided for the coil forming station with the use of a gripping device, the hook to be loaded is received by the gripping device and the receiving mandrel of the hook which is horizontal during conveying is swung into the vertical position, is raised and the individual wire windings or the wire coil are then allowed to drop onto the receiving mandrel, whereupon the loaded hook is lowered, is swung back with the receiving mandrel into the horizontal position, is inserted into the travel rail of the hook-type conveyor, the travel rail area is closed, the hook is conveyed away in the hook-type conveyor, and a next hook to be loaded is moved and the loading process is repeated.

In accordance with another further development of the method of the present invention, the travel distance of means for raising and lowering the hook in the gripping device is dimensioned such that the tip of the receiving mandrel in the raised position is located closely underneath the entry level of the cooling conveyor, wherein during loading of a hook wire windings for a subsequent hook are held back by separating fingers.

When taking into consideration the individual steps of the method according to the present invention, it is clear that, contrary to the prior art, the individual method steps are much more flexible and, thus, can be much better individually adapted to the operating parameters of a wire train and to the properties of the rolling stock. This provides a problem-free possibility for maximizing the capacity of transferring a wire coil from the coil forming chamber of a coil forming station onto a C-shaped hook of a hook-type conveyor while also realizing a problem-free operation.

In accordance with a further development of the method, in the case of a slowly traveling wire train with comparatively low production capacity, the loading process at a coil forming station is carried out without coil plate and without cap. This significantly simplifies the method or the plant.

In accordance with another feature, the gripping device is received so as to be raisable and lowerable and longitudinally displacable within a frame. This provides the very advantageous possibility of carrying out the individual method steps and movement sequences independently of each other and, thus, to carry out the steps and sequences in a very clear and functionally uncomplicated manner.

In accordance with another further development of the method, individual wire windings dropping onto the receiving mandrel or a complete wire coil are caught at the back of the hook by lateral support ledges. As a result, after opening the separating fingers, the wire coils drop as is usual in simple systems directly onto the widened back of the hook and are caught by the wider support area. Subsequently, after being lowered and swung back, the loaded hook is once again inserted into the hook travel rail. After the hook has been moved, a new empty hook is moved in for loading.

In accordance with another advantageous feature, for producing an accurate wire coil in the wire coil forming station, a cap as well as a raisable and lowerable coil plate are used and the tip of the receiving mandrel supports the cap when the hook is raised, while wire windings are collected on the coil plate in order to form a coil and this coil is gently placed from the coil plate onto the prepared back of the hook and subsequently the coil plate is lowered and the loaded hook is moved back to the hook-type conveyor and a new hook is moved in. After the second hook has been loaded and the carriage has been moved against the hook travel direction, and after this hook has been inserted into the hook-type conveyor, an empty hook is moved into the storage position.

In the case of wire trains with higher rolling efficiency in which cap, coil plate and lateral empty hooks are used, two gripping devices for rotating, lifting and moving hooks are placed on a carriage which is moveable in the travel direction of the hook-type conveyor, wherein an empty hook is always held ready to be loaded in the axial center of the coil forming chamber and hooks are removed from and again inserted into the hook-type conveyor as needed to the left or right of the coil forming chamber, and wherein a hook placed in the center of the coil forming station after having been loaded is lowered and the carriage with the gripping devices moves an empty hook into the receiving position of the coil forming chamber, wherein this hook is raised and loaded in the coil forming chamber and is then lowered and moved back by the gripping device to the hook-type conveyor, and subsequently the empty hook located laterally in a prepared position is moved in for being raised in the coil forming chamber.

This tandem arrangement shortens the cycle because, as soon as the hook located in the center of the coil station is loaded and lowered from the coil forming chamber, the carriage is moved with the two hook manipulating devices. As a result, the empty hook placed in a prepared position is ready to be raised into the coil forming chamber. Once the carriage has been moved in the travel direction of the hook-type conveyor, the prepared empty hook can be received after the loaded hook has been inserted into the hook-type conveyor.

After the second hook has been loaded and the carriage has been moved against the hook travel direction, an empty hook is moved into the storage position after the second hook has been inserted into the hook-type conveyor. Simultaneously, an empty hook is received also by the free hook manipulating system.

In accordance with another feature of the present invention, when the wire coil transfer involves the use of cap and coil plate in the coil forming chamber, either the coil plate is lowered after the transfer of the coil to the hook to such an extent that a prepared empty vertically extending hook can be moved laterally to the center of the coil forming chamber, or optionally the coil plate is moved toward the rear and the lowering distance does not have to be increased for this purpose.

In a plant for transferring a wire coil from a coil forming chamber of a coil forming station of a cooling conveyor onto a C-shaped hook of a hook-type conveyor equipped with travel rails, the hook-type conveyor includes means for opening and closing a travel rail area and a cooperating gripping device with a frame receiving the gripping device, and with a drive for swinging the hook from a horizontal position into a vertical position and vice versa, and a drive for raising and lowering a hook, and finally a drive for longitudinally moving a hook.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
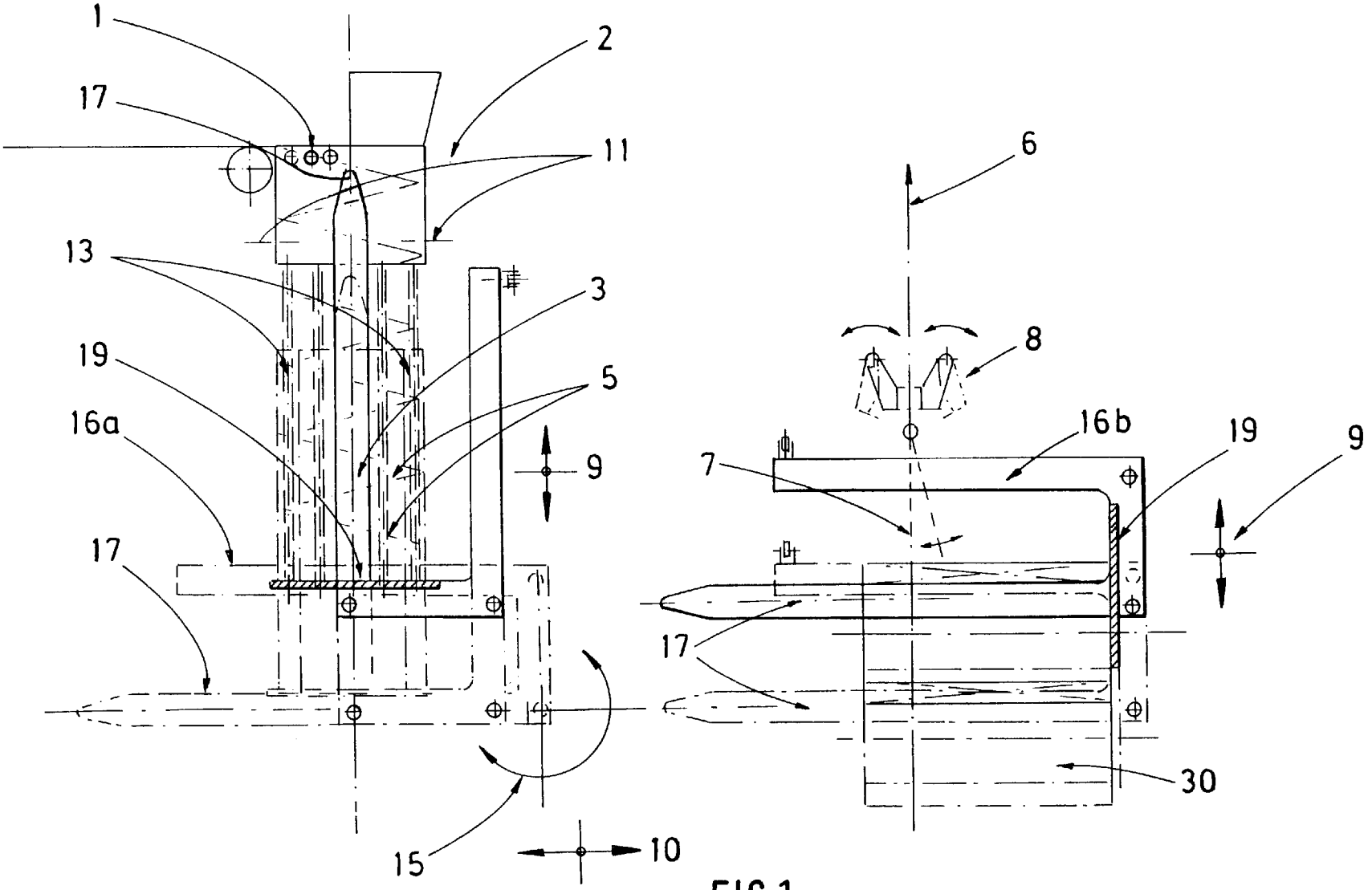
FIG. 1 is a schematic side view showing a plant for transferring a wire coil from a coil forming chamber of a coil forming station of a cooling conveyor onto a C-shaped hook of a hook-type conveyor equipped with travel rails.

FIG. 1 of the drawing shows a plant for transferring a wire coil 30 from a coil forming chamber 3 of a coil forming station 2 of a cooling conveyor 1 onto a C-shaped hook 16, 16*a*, 16*b* of a hook-type conveyor 6 equipped with travel rails, particularly for slowly moving wire trains with a relatively low production without coil and without cap. Arranged in the upper portion of the coil forming chamber 3 are separating fingers 11 which, after forming a coil, are moved in from the side in order to hold back windings 5 of a subsequently following coil in the conventional manner. As shown in FIG. 1, the wire coil is built up directly on the vertically extending receiving mandrel 17 shown in solid lines by collecting the windings 5. The initially empty hook 16*b* to be loaded is taken over by the gripping system 15 from the hook-type conveyor 6 after opening the lower travel rail area 7. This gripping system 15 is equipped with means for rotating the hook 16*b* into the vertical position, as shown in the area of the coil forming station 2.

Figure 2:
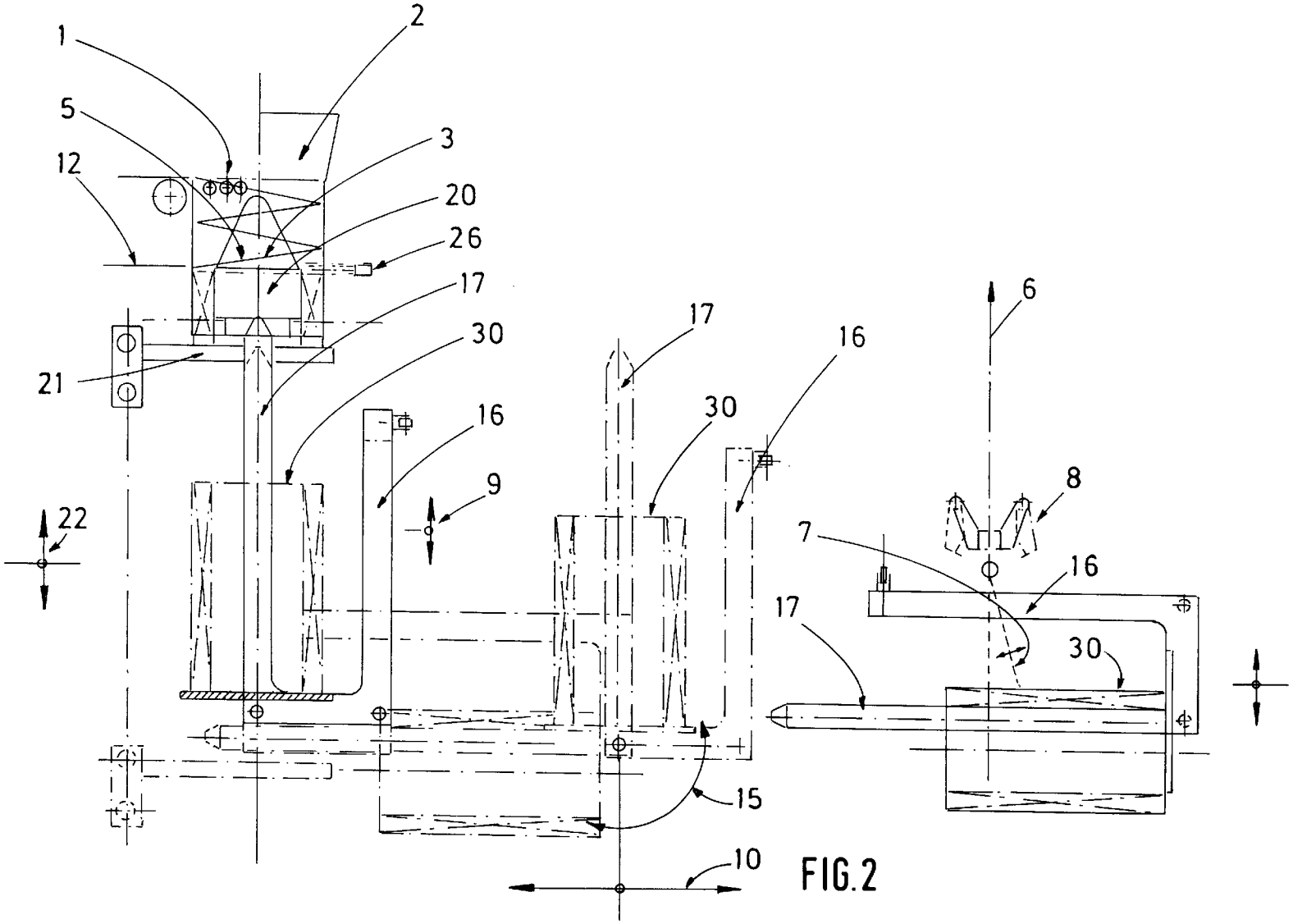
FIG. 2 is a schematic side view of the plant of FIG. 1 with a cap and coil plate.
Figure 3:
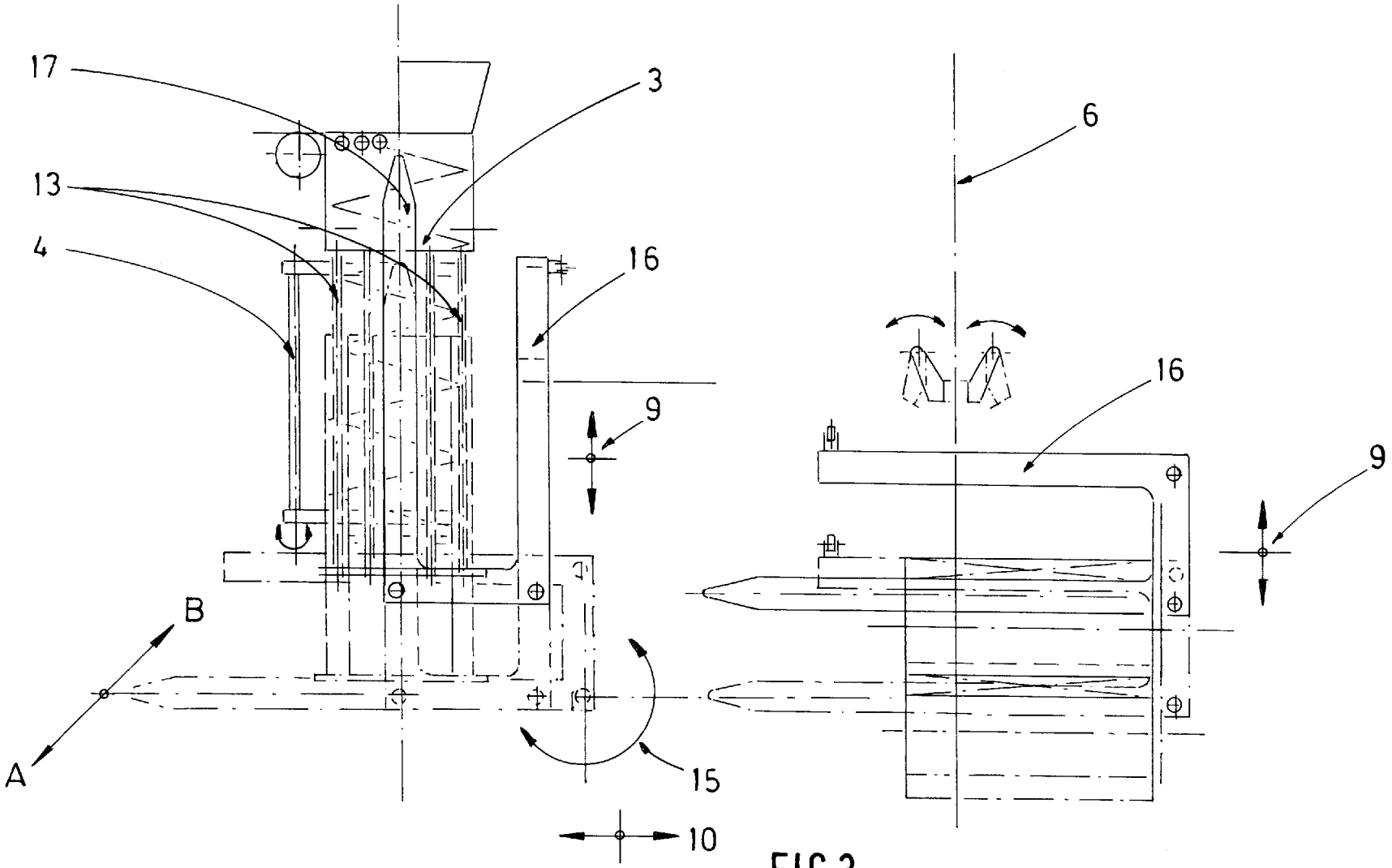
FIG. 3 is a schematic side view of another embodiment of the coil forming chamber with pivotable chamber halves.
Figure 4:
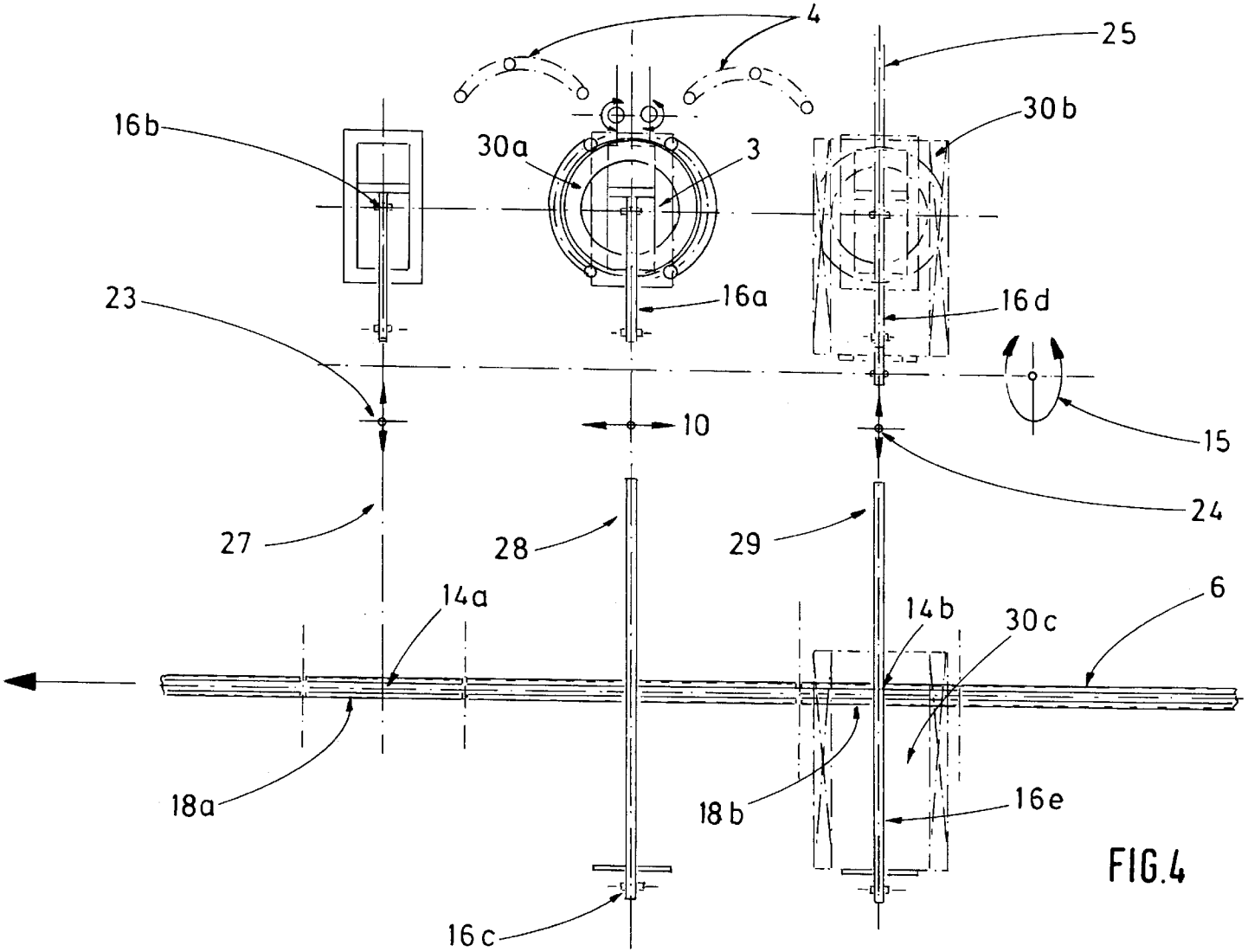
FIG. 4 is a top view of the plant with coil forming chamber and transverse conveyors as well as depositing positions for empty hook and loaded hooks.
Figure 5:
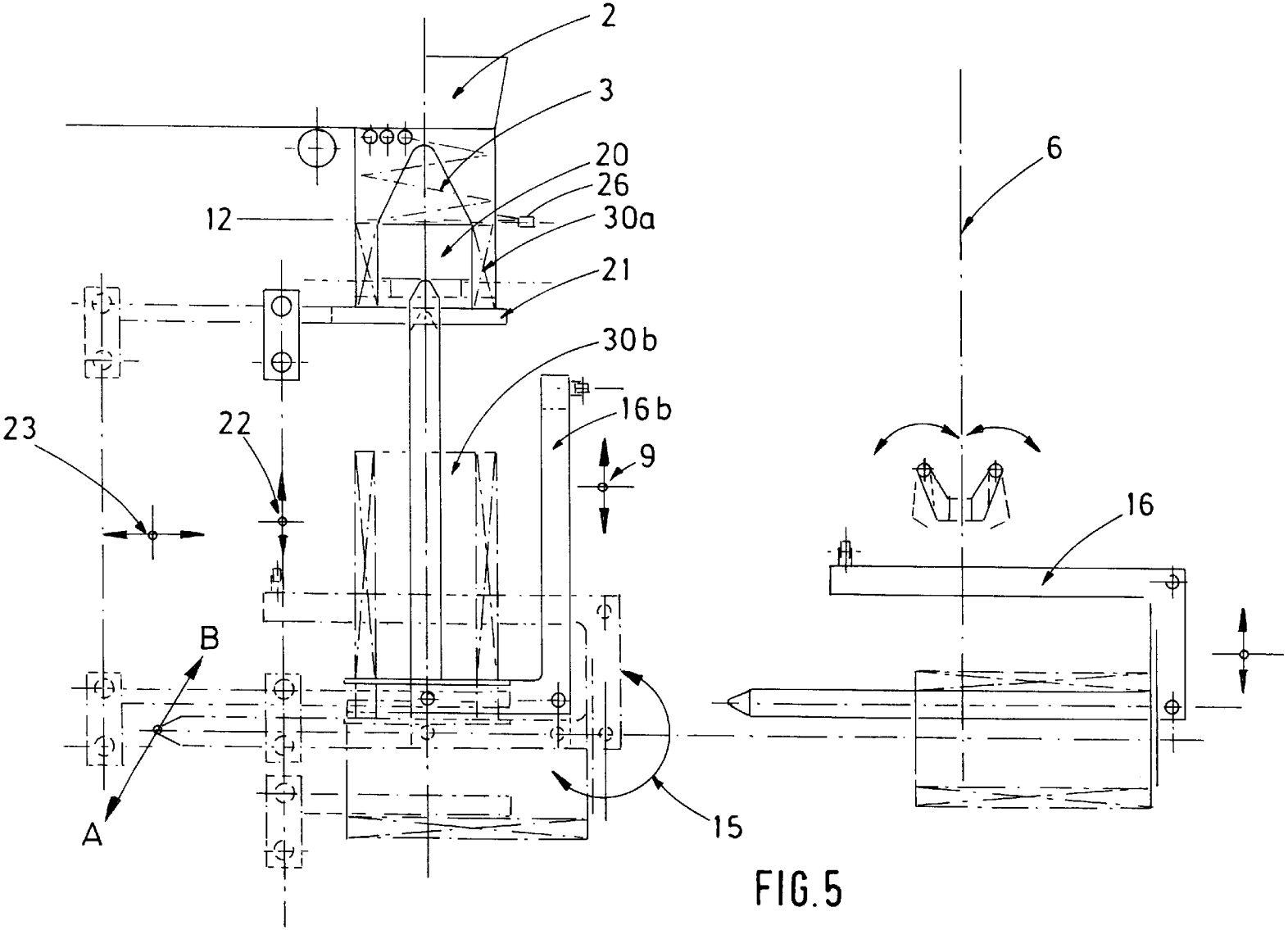
FIG. 5 is a side view of a plant with coil forming chamber which utilizes a raisable and lowerable and laterally outwardly moveable coil plate.

The coil forming chamber 3 may be equipped with pivot axes 13 for chamber halves 4, shown in FIGS. 3 and 4, which can be opened for moving out the loaded hook 16*a*. Located immediately on the back area of each hook 16 are support ledges or a support plate 19 onto which the coil 30 to be formed is placed, as shown in FIG. 2. Means 9 in the form of a drive are provided for raising and lowering the hooks 16. The hooks 16 can be raised, lowered and longitudinally moved through the individual plant elements. The means 9 together with elements for raising, lowering and longitudinally moving are preferably arranged in a separate frame which, however, is not shown for reasons of clarity.

The moving distance of the raising and lowering device 9 is dimensioned in such a way that the tip of the receiving mandrel 17 is in the raised position thereof closely below the entry level of the cooling conveyor 1. A separate drive 10 is provided for the transverse movement. After the hook 16*a* has been loaded with a coil, it is lowered by the device 9, is laterally moved by the device 10, is raised and inserted into the travel rail area 7, and is moved by the hook-type conveyor in the conveying direction after closing the travel rail area 7.

With respect to the description below of FIGS. 2–6, it is to be noted that the same functional elements are provided with the same reference numerals.

FIG. 2 shows a plant for slowly moving wire trains with low production, but with coil plate 21 and cap 20 in the shortened coil forming chamber 3 of the coil forming station 2. In this embodiment, the cap 20 ensures that a particularly good and accurate coil is formed in the coil forming chamber 3. During the formation of the coil, a horizontal coil collection line 12 is monitored by an optical monitoring unit 26 and is always maintained at a constant level while wire windings 5 are being caught by a stepwise lowering of the coil plate 21. In this embodiment of the plant, the arriving empty hook 16 is also laterally moved, after being taken over by the gripping device 15 and after opening the travel rail area 7, out of the travel rail area 7 by means of the drive 10, the hook is then placed vertically with the receiving mandrel 17, is moved underneath the coil forming station 2 in such a way that the receiving mandrel 17 coincides with the vertical axis of the coil forming station 2, after the coil plate 21 has previously been moved into the illustrated raised position in such a way that there is room for laterally moving in the hook 16. After a complete coil 30 has been received, the coil plate 21 is lowered to such an extent that the hook 16 can be lowered out of the coil forming chamber 3 into the illustrated lower position, can then be moved in the direction of the hook-type conveyor 6 and can be inserted into the travel rail area 7. The hook loaded with a coil 30 is then moved in the conventional manner in the conveying direction of the hook-type conveyor 6.

FIG. 3 shows a plant for wire trains with higher rolling capacities, but without cap and coil plate. As seen in the drawing, the coil forming chamber 3 has on the left side thereof an opened chamber half 4 which is movably hinged to one of the pivot axes 13. By providing the chamber halves 4, the coil forming chamber 3 can be opened wide, so that a hook 16, as schematically indicated by letters A and B, can be moved in and out from the side of the observer, i.e., from the front, with or without coil.

The plant illustrated in FIG. 4 is intended specifically for wire trains with higher rolling capacities without cap and coil plate. This embodiment specifically provides for a possibility of making available an empty hook 16*b* on the side. The units 10, 15, 23, 24 for rotating, raising and longitudinally moving a hook 16*a*–16*e* are provided twice and are arranged on a carriage which is moveable in the travel direction of the hook-type conveyor 6. The hook-type conveyor 6 can store an empty hook 16*c* in the axial center of the coil forming station 3. Hooks 16*b*, 16*e* can be removed from and once again inserted in the hook-type conveyor 6 to the left and right thereof. Hook transfer devices 14*a*, 14*b* are provided for this purpose. These transfer devices 14*a*, 14*b* are equipped with hook travel tracks 18*a*, 18*b* which are transversely moveable relative to the hook-type conveyor 6. Drives 23 and 24 are provided for the intermediate transport of empty or loaded hooks 16*b*, 16*d* or 16*e* transversely of the hook-type conveyor 6 along the transverse conveyors 27–29. The drive 10, which may also be provided twice, serves as type of shuttle between the transverse conveyors 27–29 from the right to the left and vice versa. Always one of the hooks 16*a*–16*e* can be swung by the gripping device 15 from the horizontal position into the vertical position. In this plant, the coil plate, not shown in the top view, is lowered after the transfer of the coil to the hook to such an extent that the empty vertically extending second hook can be moved laterally to the center of the coil station 3. If, in accordance with FIG. 6, the coil plates can be moved toward the rear, the lowering distance for the hook 16*a* or 16*b* does not have to be increased.

Figure 6:
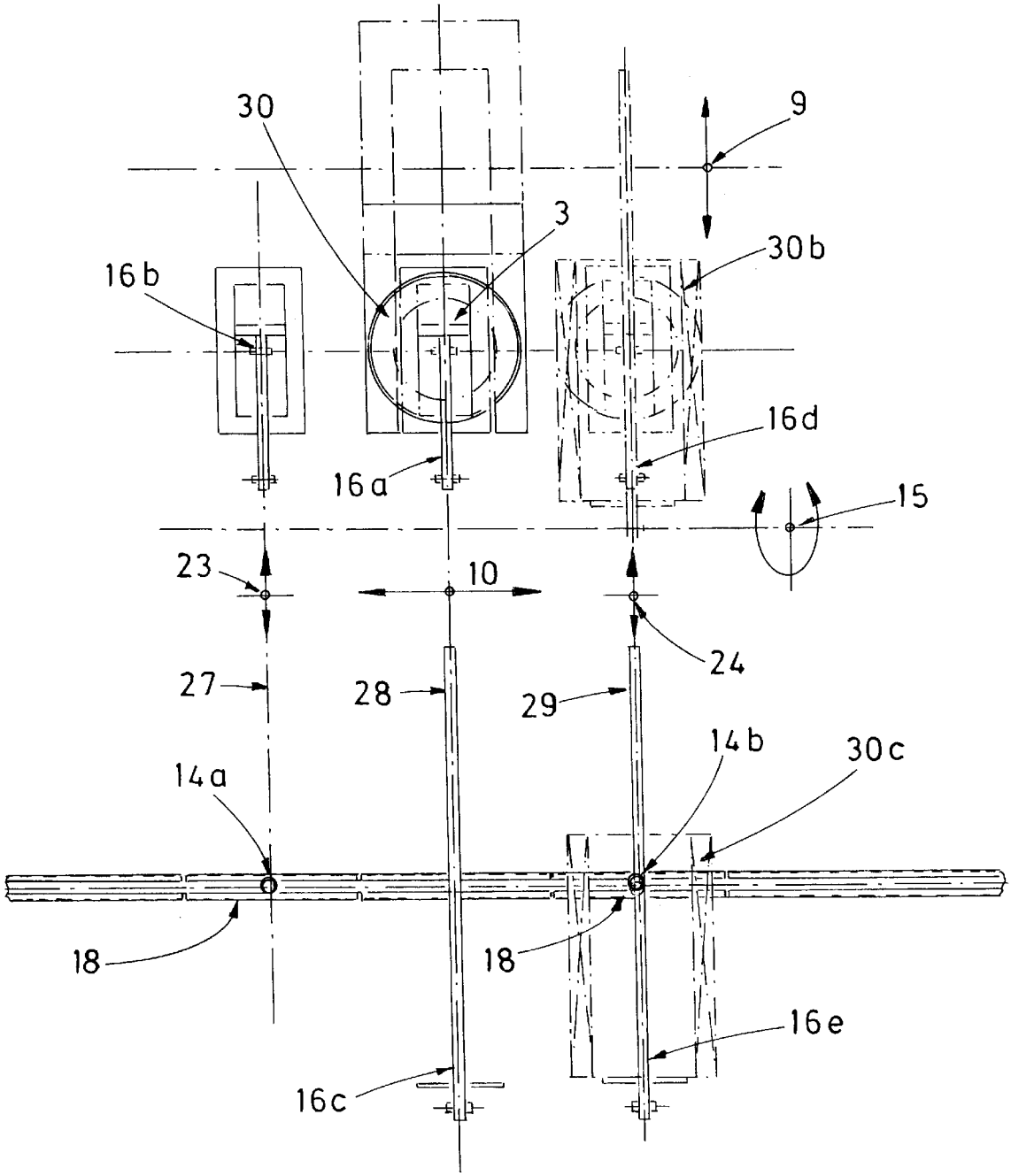
FIG. 6 is a top view of a plant for higher rolling capacities with cap and coil plate, wherein the coil plate can be moved back and forth over a smaller vertical distance.

In all other respects, the basic configuration of the plant of FIG. 6 corresponds to that of FIG. 4. Also, the embodiment of FIG. 5 substantially corresponds to that of FIG. 2. A difference is that the coil plate 21 in addition to the drive 22 for raising and lowering has an additional drive 23 for a further lateral displacement, so that the empty hook can initially be moved in the horizontal position underneath the coil forming chamber 3 of the coil forming station 2 and is only then swung in this position upwardly into the vertical position.

The plant according to the present invention is extremely useful, uncomplicated, operationally safe and free of trouble and meets the above-described object in an optimum manner.

While specific embodiments of the invention have been shown and described in detail to illustrate the inventive principles, it will be understood that the invention may be embodied otherwise without departing from such principles.

I claim:

1. A method of transferring a wire coil from a coil forming chamber of a coil forming station of a cooling conveyor onto a C-shaped hook, structured to be swung between vertical and horizontal positions, of a hook-type conveyor equipped with travel rails, the method comprising transferring the wire coil directly from the coil forming chamber onto the vertically swung hook.

2. The method according to claim 1, comprising, after opening a travel rail area of the coil forming station, transferring with the use of a gripping device said hook to be loaded to the gripping device, swinging a receiving mandrel of the hook which extends horizontally during transport into a vertical position, raising the receiving mandrel and then allowing individual wire windings or the wire coil to drop onto the receiving mandrel, subsequently lowering the loaded hook, swinging the loaded hook with the receiving mandrel back into the horizontal position, inserting the loaded hook into the travel rail of the hook-type conveyor, closing the travel rail area, conveying away the hook in the hook-type conveyor, and moving up another hook to be loaded and repeating the loading procedure.

3. The method according to claim 2, wherein a travel distance of a means for raising and lowering the hook in the gripping device is dimensioned such that a tip of the receiving mandrel in a raised position thereof is located closely underneath an entry level of the cooling conveyor, wherein, during loading of said hook, wire windings for a subsequent hook are held back by separating fingers.

4. The method according to claim 2, comprising carrying out the loading procedure in slowly operating wire trains with relatively low production capacity in a coil forming station without coil plate and without cap.

5. The method according to claim 2, wherein the gripping device is structured to be raisable and lowerable as well as longitudinally moveable in a frame.

6. The method according to claim 2, wherein individual wire windings dropping onto the receiving mandrel or a complete wire coil are caught by lateral support ledges at a back of the hook.

7. The method according to claim 6, wherein, for producing an accurate wire coil in the wire coil chamber, a cap and a raisable and lowerable coil plate are used, comprising supporting the cap by a tip of the receiving mandrel when the hook is raised, collecting wire windings on the coil plate so as to form a coil, and lowering the coil from the coil plate gently onto the back of the hook which is widened by the support ledges, and returning the loaded hook to the hook-type conveyor and moving in a new hook.

8. The method according to claim 1, wherein, for a high coil transfer capacity, two gripping devices for swinging, raising and moving hooks are used on a carriage which is displaceable in a travel direction of the hook-type conveyor, further comprising holding an empty hook in a position ready for loading in an axial center of the coil forming chamber, removing from and again returning hooks as needed from the hook-type conveyor to the left or right of the coil forming chamber, lowering a hook located in the center of the coil forming chamber after having been loaded, moving an empty hook in a receiving position of the coil forming chamber by the carriage with the gripping devices, raising the empty hook and loading the empty hook and then lowering the hook, returning the hook with the gripping device to the hook-type conveyor, so that the empty hook waiting laterally for loading is moved to be raised into the coil forming chamber.

9. The method according to claim 8, comprising, after moving the carriage in the travel direction of the hook-type conveyor and the insertion thereof in the hook-type conveyor, receiving the available empty hook and, after loading a second hook, moving the carriage against the travel direction of the hook-type conveyor, inserting the carriage into the hook-type conveyor, and moving an empty hook into a storage position, and placing another empty hook in the free gripping device.

10. The method according to claim 1, comprising, in the case of a wire coil transfer with the use of a cap and a coil plate, lowering the coil plate in the coil forming chamber after the transfer of the coil to the hook to such an extent that an available empty vertically extending hook can be moved laterally onto the center of the coil forming chamber.

11. The method according to claim 1, comprising, in a wire coil transfer using a cap and a coil plate, pushing the coil plate backwardly and not increasing the lowering distance therefor.

12. A plant for transferring a wire coil from a coil forming chamber of a coil forming station of a cooling conveyor directly onto a C-shaped hook of a hook-type conveyor equipped with travel rails, wherein the hook-type conveyor comprises means for opening and closing a travel rail area, comprising a gripping device in operative connection with the means for opening and closing and with a frame for receiving the gripping device, and with a drive for pivoting said hook from a horizontal position into a vertical position for receiving said wire coil and vice versa, further comprising a drive for lifting and lowering the hook, and a drive for longitudinally moving a hook.

13. The plant according to claim 12, wherein the hook has a back, laterally protruding supports being mounted on the back of the hook, further comprising separating fingers for holding back windings of the wire for a subsequent coil.

14. The plant according to claim 12, wherein the coil forming chamber comprises a cap and a raisable and lowerable coil plate, and an optical monitoring means for a coil collecting line.

15. The plant according to claim 12, wherein the coil forming chamber comprises chamber halves hinged at pivot axes, wherein the chamber halves are moveable between an opened position for inserting a hook and removing a coil and a closed position when a coil is being formed.

16. The plant according to claim 12, comprising two drives each for swinging, raising and lowering the hook and for displacing a carriage on which the hook is mounted, and two means for transferring the hook to the hook-type conveyor, further comprising transverse conveyors including a middle transverse conveyor and first and second outer transverse conveyors, wherein the middle transverse conveyor is configured for moving hooks or coils into and out of the coil forming chamber having open chamber halves, the first outer transverse conveyor is configured for making available an empty hook, and the second outer transverse conveyor is configured as a waiting position for a finished coil and for transferring a coil to the hook-type conveyor.

* * * * *